United States Patent [19]

Nishikawa

[11] Patent Number: 4,923,351

[45] Date of Patent: May 8, 1990

[54] BOOKBINDING AND ITS PRODUCTS

[75] Inventor: Kenjiro Nishikawa, Osaka, Japan

[73] Assignee: Maruni Kasei Kabushiki Kaisha, Osaka, Japan

[21] Appl. No.: 203,876

[22] Filed: Jun. 7, 1988

[30] Foreign Application Priority Data

Jun. 10, 1987 [JP] Japan ..... 62-143395
Mar. 5, 1988 [JP] Japan ..... 63-50625
Apr. 4, 1988 [JP] Japan ..... 63-83283

[51] Int. Cl.[5] ..... B42B 5/00

[52] U.S. Cl. ..... 412/6; 412/5; 412/7; 412/17

[58] Field of Search ..... 412/5, 6, 7, 17

[56] References Cited

U.S. PATENT DOCUMENTS 3,925,126 12/1975 Leatherman et al. ..... 412/5 X
4,149,288 4/1979 Sendor et al. ..... 412/6

FOREIGN PATENT DOCUMENTS 52-32727 3/1977 Japan ..... 412/6
216797 9/1987 Japan .

*Primary Examiner*—Paul A. Bell
*Attorney, Agent, or Firm*—Wenderoth, Lind & Ponack

[57] ABSTRACT

A method of bookbinding. Sheets to be bound have at least an edge portion which is formed of thermoplastic. A thermoplastic portion of a spine is placed against these arranged edges. Urging the spine against these edges while causing relative reciprocation therebetween in the plane of the arranged edges effects thermal bonding of the sheets to the spine. In an alternative embodiment, plain paper is used with a thermoplastic film arranged between the edges of the sheets and the thermoplastic portion of the spine.

15 Claims, 4 Drawing Sheets

BOOKBINDING AND ITS PRODUCTS

BACKGROUND OF THE INVENTION

1. Field of the Invention

The present invention relates to bookbinding and its products such as files wherein a plurality of bound sheets which are superposed with each other are bonded to an inner face of a spine of a cover at arranged ends.

2. Prior Art

Conventional bookbinding was generally achieved by adhering the arranged ends of the bound sheets to the inner face of a cover using an adhesive. It is one problem of the prior art to require use of an adhesive and another problem that a cheap adhesive having excellent adhesive strength is difficult of obtain when the bound sheets and the cover are made with a thermoplastic resin such as polypropylene.

For solving these problems, there have been known bookbinding techniques wherein the arranged ends of bound sheets formed of a thermoplastic resin are bonded to the inner face of a spine made with the same thermoplastic resin by holding the arranged ends of the superposed bound sheets in a clamping means with a slight projection of the ends. Pressing the inner face of the spine onto the ends and using a high frequency vibrator such as a ultrasonic horn from the rear side of the spine of the cover thereby weld the thermoplastic resins of the ends of the bound sheets and the inner face of the spine.

Such welding bookbinding using a high frequency vibrator has the drawback that welding time is comparatively long and thereby increases power consumption. Furthermore, the outer face of the spine is likely to melt or suffer damage or breakage due to a successive pressing of the high frequency vibrator.

SUMMARY OF THE INVENTION

It is therefore an object of the present invention to provide an improved bookbinding and its products wherein the arranged ends of the superposed bound sheets made with a thermoplastic resin are bonded by welding to the inner face of the spine of the cover made with a thermoplastic resin in a short amount of time with little power consumption and also without suffering damage or breakage at the outer face of the spine.

Another object of the present invention is to provide an improved bookbinding and its products wherein the ends of superposed bound sheets made with not only a thermoplastic resin but also other materials, such as paper, are bonded by welding to the inner face of the spine of the cover made with a thermoplastic resin in a short amount of time with little power consumption and also without suffering damage or breakage at the outer face of the spine.

In accordance with the present invention, a bookbinding product such as a file is obtained by bonding ends of the superposed bound sheets made with a thermoplastic resin to the inner face of a spine of a cover made with a thermoplastic resin by means of friction welding between the spine and the end of the bound sheets which are subjected to a mutual reciprocating motion while pressing each other.

Bookbinding according to the present invention is accomplished by pressing the ends of the superposed bound sheets made with a thermoplastic resin onto the inner face of the spine of the cover made with a thermoplastic resin, applying a micro vibration to the cover or/and the bound sheets in parallel with a contact plane, wherein the ends of the bound sheets and the inner face of the spine are pressed against each other thereby bonding the ends of the bound sheets to the inner face of the spine of the cover by means of friction welding.

Bookbinding accomplished in accordance with the present invention never damages the outer face of the spine of the cover and is less energy consumptive and a bookbinding product obtained in accordance with the invention shows a high quality appearance.

While the above bookbinding is only applicable to the combination of the bound sheets and a spine of a cover which are both formed of a thermoplastic resin, bound sheets made with other materials such as paper are not susceptible to the same bonding process. However, the present invention also provides an improved bookbinding and its product wherein even bound sheets formed of paper can be bonded with friction welding by employing a thermoplastic film. Namely, a bookbinding product according to the present invention comprises a cover having an inner face of a spine made with a thermoplastic resin, superposed bound sheets whose arranged ends are bonded by friction welding to the inner face of the cover and a thermoplastic film interposed between the inner face of the spine and the arranged ends of the superposed bound sheets. Friction welding of the end of the bound sheets to the inner face of the spine is completed by means of friction heat which is generated by a mutual reciprocating motion of the inner face of the spine and the ends of the bound sheets.

Bookbinding is accomplished by a process comprising pressing arranged ends of superposed bound sheets against a thermoplastic inner face of a spine of a cover while interposing a thermoplastic film therebetween, applying a micro vibration to the cover or/and the bound sheets in parallel with a contact plane, wherein the ends of the bound sheets and the inner face of the spine are pressed against each other to melt both the thermoplastic resin of the inner face of the spine and the thermoplastic film by friction heat generated by the micro reciprocating motion, and thereby bonding the ends of the bound sheets to the inner face of the spine of the cover.

Such thermoplastic films may have flap sheets which are superposed on either one side or both sides of the bound sheets. Such thermoplastic films may also have one or more supporting sheets to be interposed between the bound sheets.

Employing a thermoplastic film to be interposed between the ends of the bound sheets and the inner face of the spine of the cover enables the desired bookbinding for bound sheets made with not only of thermoplastic resins, but also other materials like paper.

DETAILED DESCRIPTION OF THE INVENTION

Figure 1:
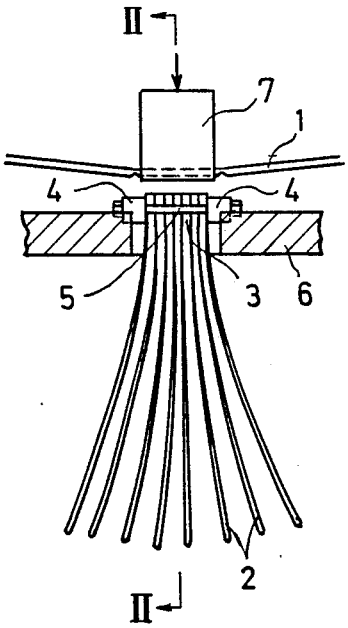
FIG. 1 is a schematic side view of an apparatus for accomplishing bookbinding in accordance with the present invention.
Figure 3:
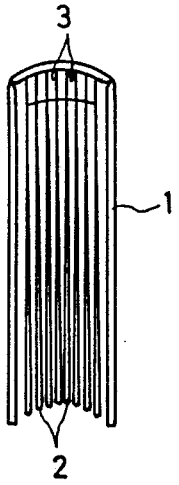
FIG. 3 is a side view of a book obtained by using the apparatus shown in FIG. 1.
Figure 2:
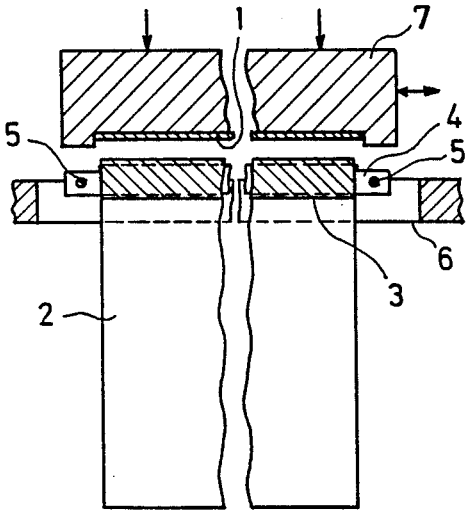
FIG. 2 is a sectional view taken along II—II line in FIG. 1.

In FIG. 1 and FIG. 2, reference numeral 1 indicates a cover formed of a thermoplastic resin like polypropylene, 2 shows bound sheets of a bag shape having a front opening and formed of a thermoplastic resin of the same kind as that of the cover. 3 denotes spacer sheets, again formed of the same kind of resin. The spacer sheets and bound sheets are alternated and superposed with the edges or ends thereof appropriately arranged. 4 is a clamping means having fastening bolts 5 for securing the bound sheets 2 and the spacer sheets 3 slightly projecting above the clamping means 6 indicates a setting table which secures the clamping means 4 so as not to move in the lateral direction in FIG. 2. 7 denotes pressing means having a shallow groove in which a spine of the cover 1 its received. An inner face of the spine is pressed onto the thus arranged ends of the bound sheets 2 and the spacer sheets 3. The pressing means 7 is reciprocated in the lateral direction in FIG. 2 with a vibration amplitude of 0.5 to 2.0 mm and at a frequency of 150 to 300 cycles per second while keeping the above pressing action. Thus, friction heat is generated between the inner face of the spine of the cover 1 and the ends of the sheets 2 and thereby the thermoplastic resins melt. Upon stopping the reciprocating motion of the pressing means, and optionally blowing cold air to cool them, the ends of the bound sheets and the spacer sheets are bound to the inner face of the spine. Raising the pressing means 7, the cover 1 is retained at the setting table together with the bound sheets 2 and spacer sheets 3. Detaching the clamping means 4 from the setting table and detaching the now integral unit of the cover, bound sheets and spacer sheets from the clamping means, a bookbinding product having a curved spine with excellent appearance is obtained as shown in FIG. 3.

Figure 4:
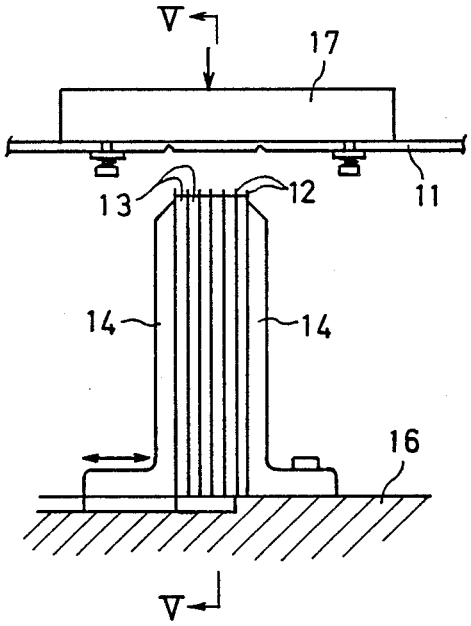
FIG. 4 is a schematic side view of another apparatus for accomplishing bookbinding in accordance with the present invention.
Figure 6:
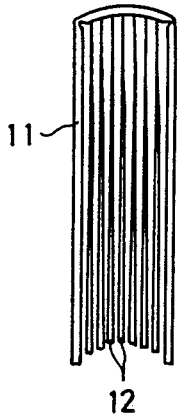
FIG. 6 is a side view of a book obtained by using the apparatus shown in FIG. 4.
Figure 5:
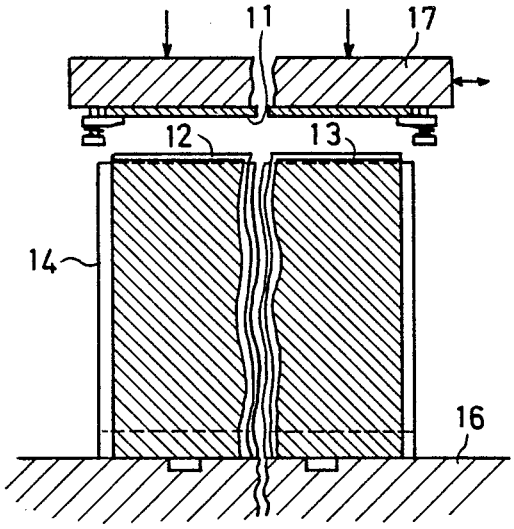
FIG. 5 is a sectional view taken along V—V in FIG. 4.

FIG. 4 and FIG. 5 show another apparatus for accomplishing bookbinding in accordance with the present invention. Reference numerals 11 and 12 indicate a cover and bound sheets, respectively, which are made with the same thermoplastic resin as in the above example. 13 shows spacer sheets formed of a material like cardboard, which is not susceptible to friction welding with a spine of the cover 11. 14 shows clamping means, one of which is fixed on a table 16 and another of which is movable in the direction of the arrows on the table 16 by the action of driving means like plungers. 17 indicates a pressing means which is movable up and down by the action of a lifting means and to which the cover 11 is secured by any suitable means. The pressing means 17 can be reciprocated in the lateral direction in FIG. 5 by driving means with a vibration amplitude of 0.5 to 2.0 mm and at a frequency of 150 to 300 cycles per second. The bound sheets 12 and the spacer sheets 13 are alternated and superposed with the ends thereof appropriately arranged. These composite sheets are then set vertically on the table 16 between the clamping means 14. Moving the movable clamping means to the right in the drawing, the composite sheets are held by the clamping means. As shown in the drawing, the upper ends of the spacer sheets 13 project slightly above the upper ends of the clamping means and the upper ends of the bound sheets 12 projects from the upper ends of the spacer sheets 13 by approximately 1 mm. The pressing means 17, having the cover 11 secured thereto, is then moved downwards to press the inner face of the spine of the cover onto the upper ends of the bound sheets and is also reciprocated laterally in FIG. 5. By friction heat generated by the above action of the pressing means, the upper ends of the bound sheets 12 are bonded by friction welding to the inner face of the spine. Stopping the reciprocating motion of the pressing means, detaching the cover from the pressing means, releasing the clamping means and removing the spacer sheets interposed between the bound sheets, a binding product having the curved spine which shows an excellent appearance is obtained as shown in FIG. 6.

In the present invention, the cover, bound sheets and spacer sheets are not necessarily required to be formed entirely of a thermoplastic resin, so long as the end or edge portions thereof are of a thermoplastic resin. Omitting spacer sheets, using the bound sheets of a plain sheet form, reciprocating the pressing means in the lateral direction in FIG. 1 and FIG. 4 or reciprocating both the cover and the bound sheets may be all applicable in the present invention.

Figure 11:
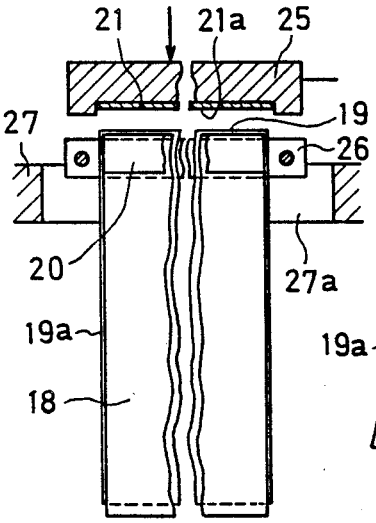
FIG. 11 is a cross-sectional view taken along line XI—XI in FIG. 10.
Figure 12:
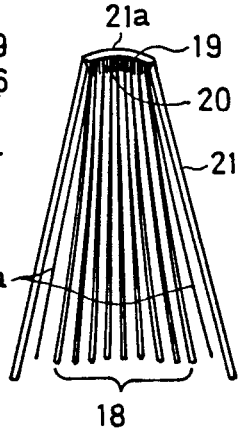
FIG. 12 is a side view of a book obtained by using the apparatus shown in FIG. 10.
Figure 13:
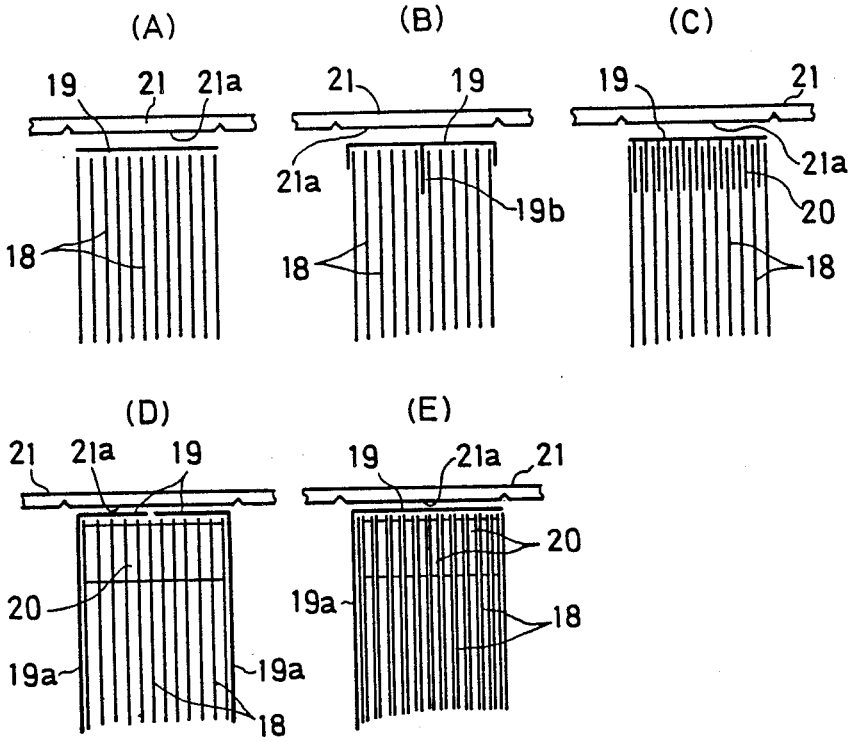
FIGS. 13, (A) to (E) are diagrams of examples for interposing the thermoplastic film between an inner face of a spine of a cover and ends of bound sheets.

FIG. 7 through FIG. 13 show further the present invention. Reference numeral 18 shows bound sheets, 19 indicates a thermoplastic film which is interposed between an inner face of a spine of a cover 21 and the appropriately arranged ends of the bound sheets, 20 indicates spacer sheets and 21 is the cover. An inner face 21*a* of a spine of the cover 21 is made with a thermoplastic resin such as polypropylene, polyvinyl chloride, etc. Making the cover entirely from a thermoplastic resin may be preferable from the viewpoint of durability and economy. The thermoplastic film 19 may be a plain sheet as shown in FIG. 13 (A) or may be united with flap sheets 19*a* which are superposed on one or both sides of the bound sheets 18 as shown in FIG. 13 (D) or (E). The thermoplastic film 19 may be also united with one or more supporting sheets 196 which are interposed between the bound sheets as shown in FIG. 13 (B) or united with the spacer sheets 20 as shown in FIG. 13 (C). Making the flap sheets 19*a* and the thermoplastic film 19 from the same thermoplastic resin as a unit may be preferable from the viewpoint of durability and economy. The bound sheets 18 may be of plain sheet form or of a bag shape which is suitable for making a file. The material of the bound sheets may be paper or thermoplastic resins which can be bonded by friction welding to the cover and the thermoplastic films. In making a file, bound sheets 18 having a bag shape are preferably formed from a thermoplastic resin from the viewpoint of processability and durability. The spacer sheets 20 may be bonded together with the bound sheets 18 to the cover 21 or may not be bonded so as to be detached from the bound sheets after the bound sheets are bonded to the cover. For bonding purposes, the spacer sheets are made of a thermoplastic resin. For detaching purpose, they are made of papers, metal or plastic materials which can not bond to a thermoplastic resin used for the flap sheets 19*a* or the cover 21.

Figure 7:
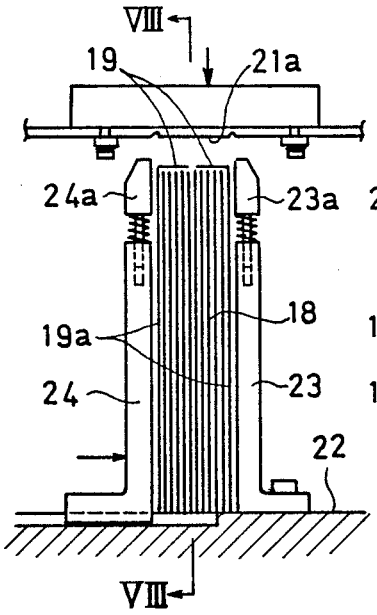
FIG. 7 is a schematic side view of an apparatus for accomplishing bookbinding using a thermoplastic film in accordance with the present invention.
Figure 8:
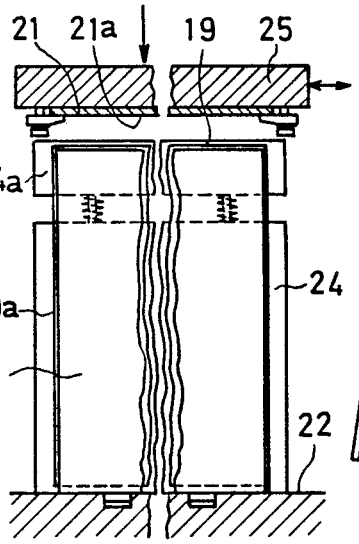
FIG. 8 is a sectional view taken along VIII—VIII line in FIG. 7.

Bookbinding using the apparatus shown in FIG. 7 and FIG. 8 is accomplished as follows.

The upper ends of the superposed bound sheets 18 are arranged on a table 22. The flap sheets 19*a* are superposed on both sides of the bound sheets 18 and the thermoplastic films 19 united with the flap sheets are overlaid on the upper ends of the bound sheets. The flap sheets and the bound sheets are then clamped by clamping means 23,24. The clamping means 23 is fixed on the table 22. The clamping means 24 is movable by means of driving means like a piston, screw or so forth. Pressing means 25 securing the cover 21 is moved downward by means of a piston, screw or so forth, and presses the inner face 21*a* of the spine of the cover 21 onto the thermoplastic films 19 and the upper ends of the bound sheets. The pressing means 25 is then reciprocated in the lateral direction in FIG. 8 with a vibration amplitude of 0.5 to 2.0 mm and a frequency of 150 to 300 cycles per second. This action of the pressing means generates friction heat between the thermoplastic films 19 and the inner face 21*a* of the spine of the cover to melt the resin of both the thermoplastic films and the inner face of the spine. Stopping the reciprocating motion of the pressing means, the bound sheets 18 and the films 19 are bonded by friction welding to the inner face of the spine. The reciprocating direction of the pressing means may be lateral in FIG. 7.

The bound sheets 18 are bonded to the cover 21 by means of the molten thermoplastic films 19. It is thus preferable that the thermoplastic films 19 cover the upper ends of the bound sheets 18 entirely. A slight gap between the thermoplastic films may be admissible because the molten resin flows over and covers the entire region of the upper ends. It will be preferable that the thermoplastic films 19 are not overlapped with each other, because the overlapped portion may take a longer to be melted and the bonding time may thus be prolonged. The flap sheets 19*a* may be superposed on only one side of the bound sheets. Superposing on both sides as in the example above, the appearance of the book is beautiful. Besides the upper end of the bound sheets being covered by a pair of thermoplastic films 19 as shown in the drawing, the thermoplastic films can easily be set in good alignment with the bound sheets. It is preferable that lower ends of the flap sheets 19*a* terminate slightly inwardly of lower ends of the bound sheets.

As shown in FIG. 7 and FIG. 8, the clamping means 23,24 have upper portions 23*a*,24*a* which are slidably mounted on the clamping means 23,24 by means of slidable pins and springs. The pressing means presses the inner face of the spine of the cover onto the thermoplastic films and the upper ends of the bound sheets, pressing down the upper portions 23*a*,24*a*. Since the thermoplastic films and the upper ends of the bound sheets are held by said upper portions 23*a*,24*a*, the arrangement and alignment thereof are not disturbed by the reciprocating motion of the pressing means. Adjustable upper portions which can be set on the clamping means having upper ends positioned in the same horizontal plane as the upper ends of the bound sheets may be also applicable. For bound sheets having a giving dimension, a clamping means having the same dimension may be applicable without providing such an adjustable means. Being bonded to the inner face 21*a* of the spine of the cover 21 by means of the molten thermoplastic films 19, the bound sheets can also be made of paper or any suitable material other than thermoplastic resin. Employing the flap sheets 19*a* serves to completely and beautifully bond the bound sheets, especially the outermost bound sheets. to the inner face of the spine of the cover.

Figure 9:
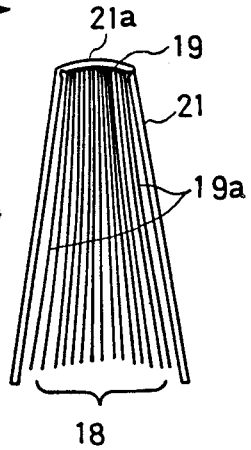
FIG. 9 is a side view of a book obtained by using the apparatus shown in FIG. 7.

When the bound sheets and the flap sheets have been bonded to the inner face of the spine, the cover is detached from the pressing means and the clamping means is opened. Then a book having the curved spine with an excellent appearance is obtained as shown in FIG. 9.

Figure 10:
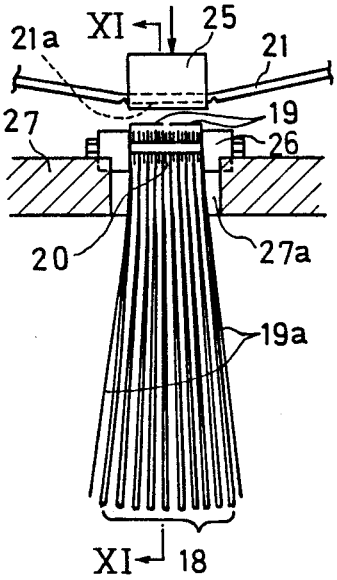
FIG. 10 is a schematic side view of an apparatus for accomplishing bookbinding using a thermoplastic film in accordance with the present invention.

Bookbinding using the apparatus shown in FIG. 10 and FIG. 11 is accomplished as follows.

Between the upper ends of the superposed bound sheets 18 the spacer sheets 20 are interposed. The flap sheets 19 are superposed on either both sides of the bound sheets as shown in FIG. 13 (D) or one side as shown in FIG. 13 (E) and the thermoplastic films or film united with the flap sheets or sheet are overlaid on the upper ends of the composite sheets consisting of the bound sheets and the spacer sheets. Then the composite sheets are held by clamping means 26 with the upper ends of the composite sheets and the thermoplastic film, projecting slightly therefrom or film. The clamping means 26 are secured by a setting table 27 which has an aperture 27*a* through which the composite sheets are hung. Pressing means 25 securing the cover 21 is then moved downward to press the inner face 21*a* of the cover onto the thermoplastic films or film 19 and the upper end of the composite sheets. The pressing means 25 is then reciprocated in the same manner as described in connection with the example shown in FIG. 7 and FIG. 8 to bond by friction welding the bound sheets 18, films or film 19 and spacer sheets 20 to the inner face 21*a* of the spine of the cover 21. Consequently a book having a curved spine with an excellent appearance is obtained as shown in FIG. 12. Shown in the drawings is an example for a file, consisting of bound sheets 18 of a bag shape. The spacer sheets 20 become detachable when they are made of materials which can not be bonded by friction welding or when they are set slightly inwardly of the upper ends of the composite sheets even if they are made with a thermoplastic resin.

I claim:

1. A method of bookbinding, comprising the steps of:

providing a plurality of sheets, each of said sheets having at least a portion of an edge thereof which includes a first thermoplastic, spine means having an inner face, at least a portion of said inner face including a second thermoplastic, clamp means for clamping said sheets, and press means;

arranging said sheets in a substantially superposed relation with said edges substantially superposed;

clamping said sheets to maintain said edges in essential alignment, said edges thereby defining a surface;

placing said portion of said spine means in contact with said edges and said press means in contact with said spine means at a position opposite said edges; and urging said press means against said edges to apply a force to said spine means and therefore said edges while causing relative reciprocation between said spine means and said sheets within a plane substantially parallel to said surface defined by said edges, whereby friction heat generated by said reciprocation bonds said sheets to said spine means.

2. A method as in claim 1, wherein said first and said second thermoplastic have substantially identical compositions.

3. A method as in claim 1, wherein said step of providing a plurality of sheets comprises providing a plurality of sheets formed entirely of a first thermoplastic.

4. A method as in claim 1, wherein said step of providing further comprises providing a plurality of spacer sheets, each of said spacer sheets having at least a portion of an edge thereof which includes a third thermoplastic, said step of arranging further comprises arranging said sheets and said spacer sheets in a substantially superposed alternating relation with said edges of said sheets and said edges of said spacer sheets substantially superposed, and said step of clamping further comprises clamping said sheets and said spacer sheets, whereby the friction heat generated by said reciprocation in said urging step bonds said sheets and said spacer sheets to said spine means.

5. A method as in claim 4, wherein said first, said second and said third thermoplastic have substantially identical compositions.

6. A method as in claim 1, wherein said step of providing a plurality of spacer sheets comprises providing a plurality of spacer sheets formed entirely of a third thermplastic.

7. A method as in claim 6, wherein said step of providing a plurality of sheets comprises providing a plurality of sheets formed entirely of a first thermoplastic.

8. A method as in claim 1, wherein:

said step of providing a plurality of sheets further comprises providing a plurality of spacer sheets;

said step of arranging comprises arranging said sheets and said spacer sheets in a substantially superposed alternating relation with said edges of said sheets extending outwardly beyond said spacer sheets; and said step of clamping further comprises clamping said sheets and said spacer sheets, whereby the friction heat generated by said reciprocation in said urging step bonds said sheets to said spine means but does not bond said spacer sheets to said spine means.

9. A method as in claim 8, wherein said first and said second thermoplastic have substantially identical compositions.

10. A method as in claim 8, wherein said step of providing a plurality of sheets comprises providing a plurality of sheets formed entirely of a first thermoplastic.

11. A method of bookbinding, comprising the steps of:

providing a plurality of sheets, spine means having an inner face, at least a portion of said inner face including a first thermoplastic, at least one film formed of a second thermoplastic, clamp means for clamping said sheets, and press means;

arranging said sheets in a substantially superposed relation with at least one edge of said sheets substantially superposed;

placing said film at least over substantially all of one of said at least one edge of said sheets;

clamping said sheets to maintain said one edge of said sheets in essential alignment, said one edge of said sheets thereby defining a surface at least substantially covered by said film;

placing said portion of said spine means in contact with said film and said press means in contact with said spine means, both at a position opposite said one edge of said sheets; and urging said press means against said one edge to apply a force to said spine means and therefore said at least one film and said one edge of said sheets while causing relative reciprocation between said spine means and said sheets within a plane substantially parallel to said surface defined by said one edge of said sheets, whereby friction heat generated by said reciprocation bonds said at least one film to said sheets and said spine means.

12. A method as in claim 11, wherein said step of providing further comprises providing a plurality of spacer sheets, each of said spacer sheets having at least a portion of an edge thereof which includes a second thermoplastic, said step of arranging further comprises arranging said sheets and said spacer sheets in a substantially superposed alternating relation with said one edge of said sheets and said one edge of said spacer sheets substantially superposed, and said step of clamping further comprises clamping said sheets and said spacer sheets, whereby the friction heat generated by said reciprocation in said urging step bonds said at least one film to said sheets, said spacer sheets and said spine means.

13. A method as in claim 11, wherein said step of providing at least one film comprises providing at least one film formed of a second thermoplastic and having at least one spacer sheet connected to and extending freely from an intermediate portion of said film, and said step of placing further comprises inserting each said spacer sheet between an associated pair of said sheets.

14. A method as in claim 11, wherein said step of providing at least one film comprises providing a plurality of films formed of a second thermoplastic and no more than two of said films each having a flap sheet connected to and extending freely from an edge of the associated said film, and said step of placing said film further comprising placing each said flap sheet in substantially superposed relation with said sheets.

15. A method as in claim 11, wherein said step of providing at least one film comprises providing a film formed of a second thermoplastic and said film having no more than two flap sheets connected at respective opposed edges of said film and extending freely therefrom, and said step of placing said film further comprising placing each said flap sheet in substantially superposed relation with said sheets.

* * * * *